United States Patent [19]

Tapper

[11] Patent Number: 5,065,675

[45] Date of Patent: Nov. 19, 1991

[54] BOUNDARY LAYER AIR SCRAPER FOR A ROTOGRAVURE PRINTING PRESS

[75] Inventor: Lee C. Tapper, Winona Lake, Ind.

[73] Assignee: R. R. Donnelley & Sons Company, Chicago, Ill.

[21] Appl. No.: 652,012

[22] Filed: Feb. 7, 1991

[51] Int. Cl.[5] ..... B41F 9/10; B41F 9/16

[52] U.S. Cl. ..... 101/153; 101/169

[58] Field of Search ..... 101/152, 153, 157, 169, 101/140, 365, 366, 417, 424.1, 216, 219, 228, 425; 34/155, 140, 175, 156, 161, 231; 15/256.51

[56] References Cited

U.S. PATENT DOCUMENTS

| | | | |
|---|---|---|---|
| 1,196,090 | 8/1916 | Doyle | 101/425 |
| 2,022,635 | 11/1935 | Durham | 101/157 |
| 2,040,961 | 5/1936 | Stouch | 101/157 |
| 2,126,778 | 9/1938 | Horton | 101/157 |
| 2,141,978 | 12/1938 | Greenhill | 101/157 |
| 2,256,515 | 9/1941 | Brueshaber | 101/157 |
| 3,108,539 | 10/1963 | Champion et al. | 101/425 |
| 3,264,673 | 8/1966 | Scott | 15/256.51 |
| 3,624,860 | 12/1971 | Grimston et al. | 15/256.51 |
| 3,829,927 | 8/1974 | Boyland | 15/256.51 |
| 3,988,988 | 11/1976 | Sable | 101/169 X |

FOREIGN PATENT DOCUMENTS

| | | | |
|---|---|---|---|
| 449112 | 6/1936 | United Kingdom | 101/157 |
| 477752 | 1/1938 | United Kingdom | 101/157 |

*Primary Examiner*—J. Reed Fisher

*Attorney, Agent, or Firm*—Wood, Phillips, Mason, Recktenwald & VanSanten

[57] ABSTRACT

A rotogravure printing press includes a boundary layer air scraper which is located immediately upstream of the pinch area of the press (e.g. the area formed by the impression roller and the printing cylinder). The air scraper blocks boundary layer airflow drawn with the moving web. This reduces the solvent laden air and allows a reduction in the capacity of the scavenger system.

11 Claims, 3 Drawing Sheets

Fig. 3
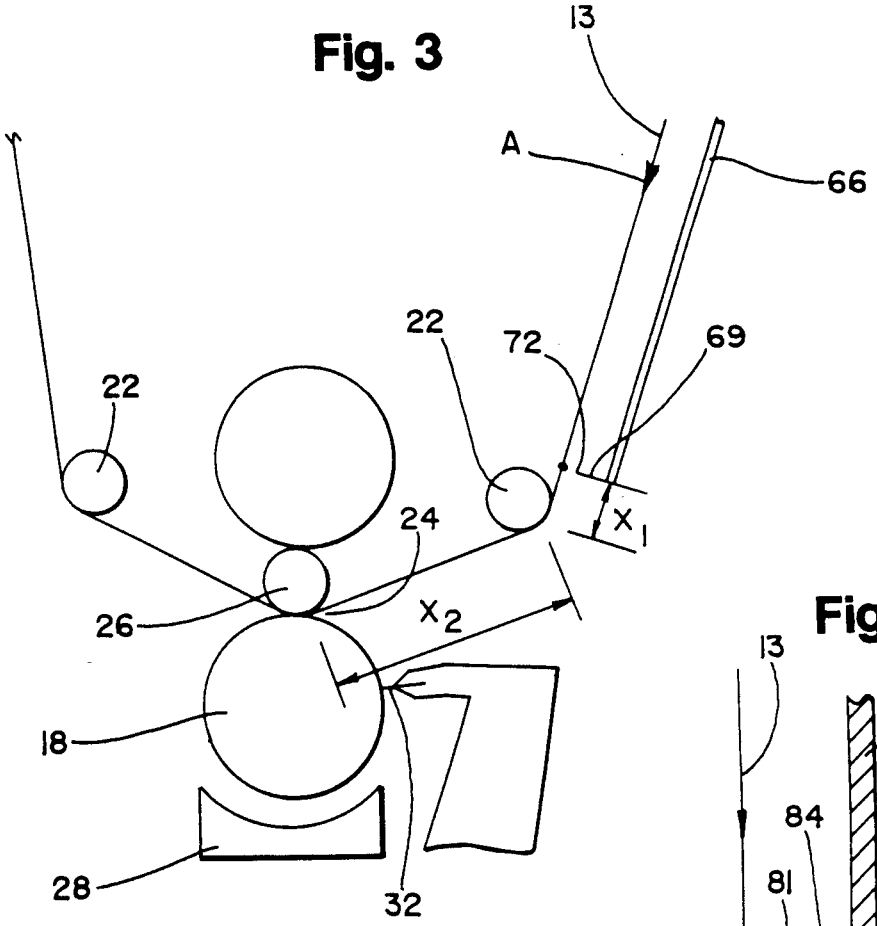
Fig. 5
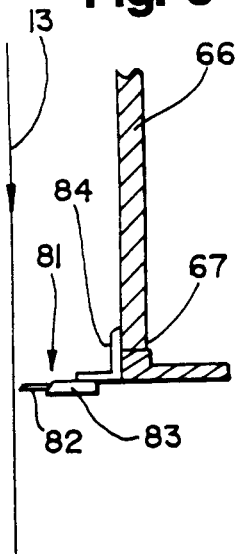
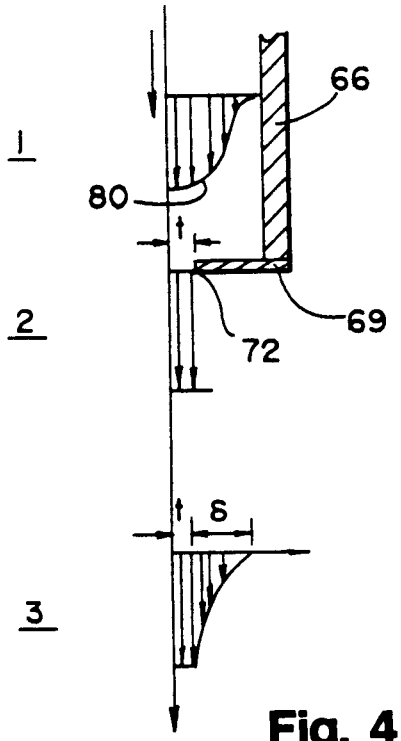
Fig. 4

BOUNDARY LAYER AIR SCRAPER FOR A ROTOGRAVURE PRINTING PRESS

FIELD OF THE INVENTION

This invention relates to a rotogravure printing press with a scavenger and boundary layer air scraper to minimize the escape of solvent fumes.

BACKGROUND OF THE INVENTION

A rotogravure press has a printing cylinder with engraved ink wells on the surface. The cylinder rotates through an ink fountain or bath to fill the wells. A doctor blade scrapes excess ink from the cylinder surface. The web to be printed is directed to a pinch between the printing cylinder and an impression cylinder. The ink in the wells is transferred to the web in the pinch. The web typically travels at a high speed, drawing air, sometimes referred to as boundary layer air, with it. The ink has a volatile solvent which is picked up by the boundary layer air that strikes the cylinder surface between the doctor blade and pinch. The solvent laden air is dispersed in the press area, presenting a hazard to the press operators.

My U.S. Pat. application Ser. No. 317,759, filed Mar. 2, 1989, now U.S. Pat. No. 5,014,616, and assigned to the assignee of this application, discloses a scavenger mounted on the doctor blade table for exhausting solvent laden air from the press area.

This invention is concerned with a boundary layer air scraper which reduces the volume of air drawn to the printing cylinder by the moving web and thus reduces the capacity required in the scavenger.

SUMMARY OF THE INVENTION

A principal feature of the invention is the provision of an air scraper having a panel adjacent the moving web and extending upstream of the web from a first end adjacent the pinch and scavenger to a second end spaced therefrom, and a scraper blade at the first end of the panel, extending from the panel toward the web to block the flow of boundary layer air drawn by the web to the printing cylinder.

Another feature is that the panel and scraper blade have a width substantially equal to the width of the paper web.

A further feature is that the panel is generally parallel with the web and the scraper blade is a plate extending from the panel generally at right angles to the web.

Yet another feature is that the scraper blade is conductive to dissipate static electricity in the web.

And a further feature is that the scraper blade is flexible to deflect and allow passage of foreign articles on the web.

Further features and advantages of the invention will readily be apparent from the following specification and from the drawings.

BRIEF DESCRIPTION OF THE DRAWINGS

FIG. 3 is a diagrammatic view, similar to that of FIG. 2, illustrating physical variables which are considered in calculating the volume of boundary layer air flow;

FIG. 4 is a diagram illustrating the boundary layer air flow at three positions on the web in the vicinity of the scraper blade; and FIG. 5 is a fragmentary section through the scraper blade illustrating a preferred embodiment of the blade.

DETAILED DESCRIPTION OF THE INVENTION

A gravure printing press is indicated generally at 10 and has a boundary layer air scraper 12 of the present invention. It is to be understood that the gravure printing press 10 is one of eight identical printing press units which together comprise a four-color printing press and wherein a continuous web 13 is sequentially caused to be printed on both surfaces. The gravure printing press 10 in FIG. 1 is illustrative of a press applying one of the four colors on one of the surfaces of the continuous web 13.

Figure 1:
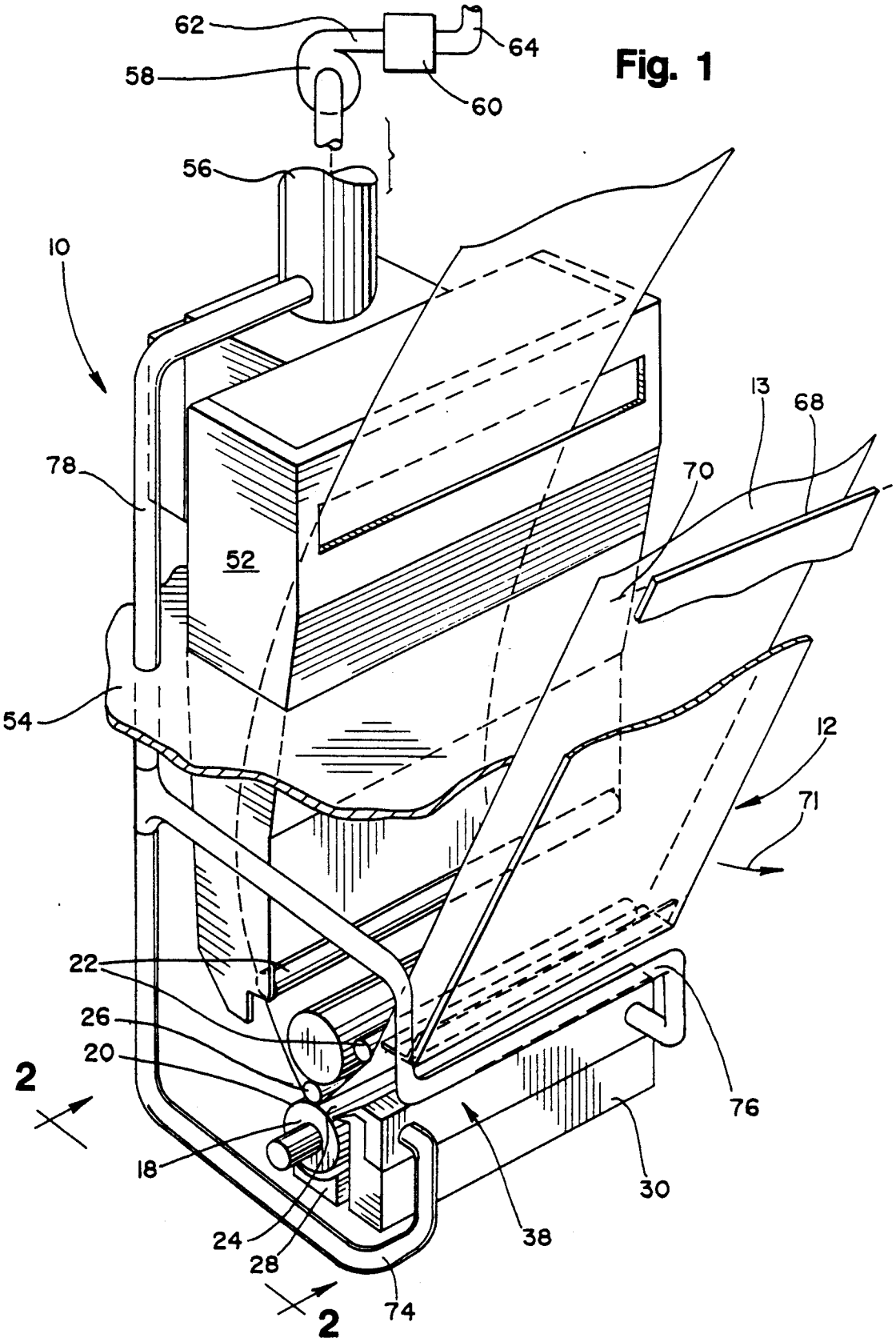
FIG. 1 is a diagrammatic perspective view of a gravure printing press with a boundary layer air scraper.

The printing press 10 includes a printing cylinder 18 which is rotatable in the counterclockwise direction as viewed from the left of FIG. 1 and has an outer surface 20. A plurality of idler rollers 22 direct the continuous web 13 through a pinch 24 of the printing press 10 and to a dryer 52. The pinch 24 is formed between impression roller 26 and the outer surface 20 of the printing cylinder 18. The printing press 10 includes an ink fountain 28 extending the length of the printing cylinder 18 which supplies ink to the outer surface 20 of the printing cylinder 18 for transfer to the continuous web 13. Contained in the ink is a volatile solvent which constitutes approximately 80% of the ink.

The printing press 10 includes a blade table 30 extending the length of printing cylinder 18. The blade table 30 carries a doctor blade 32, FIG. 2, which is in contact with the outer surface 20 of the printing cylinder 18 and removes excess ink from the surface as the cylinder rotates from ink fountain 28 to the pinch 24. A scavenger, generally designated 38, is mounted on top of the blade table 30, and includes a chamber 40 which extends the length of printing cylinder 18. The chamber 40 has a front wall 42 from which an inlet portion 44 extends. The inlet portion 44 extends the length of the printing cylinder 18 and is positioned a close as operationally feasible to the outer surface 20 of the printing cylinder 18, between the doctor blade 32 and the pinch 24. The scavenger 38 is mounted on top of the blade table 30 and a bottom surface 46 of inlet portion 44 is placed over the top surface 48 of doctor blade 32 in such a manner that all like parts coincide.

The chamber 40 of scavenger 38 includes a back wall 50 to which ducts 74 and 76 are connected. The ducts 74 and 76 are in turn connected to duct 78. Duct 78 is connected to exhaust duct 56 and associated web dryer 52. The dryer 52 extends from the lower portion of the press unit 10 to an upper portion separated from the lower portion by a deck 54. The dryer exhaust duct 56 is connected to an exhaust fan 58, which in turn, is connected to a solvent recovery system 60 by means of a duct 62. The solvent recovery system 60 is connected to a suitable venting mechanism (not shown) by duct 64 to release the remaining dryer exhaust to the atmosphere.

Further details of the scavenger are described in my aforementioned pending application.

Figure 2:
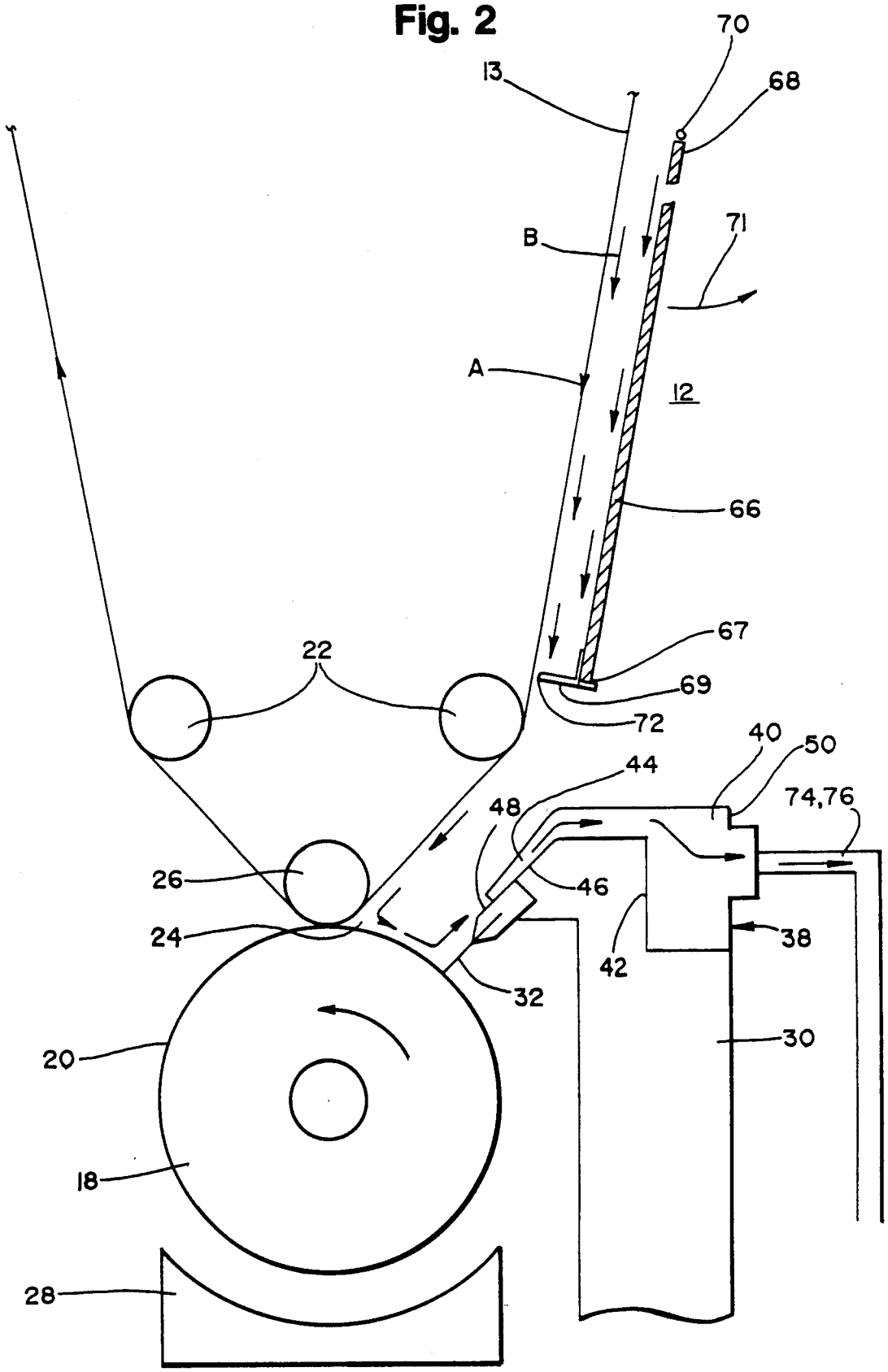
FIG. 2 is an enlarged diagrammatic elevation of the scraper, cylinder, ink fountain, doctor blade and scavenger, taken generally along line 2—2 of FIG. 1.

With particular reference to FIG. 2, as the web 13 travels into the printing press 10 (in the direction of the arrow A), a boundary layer of air is induced to flow with the web (as indicated by the arrow B). As the web 13 enters the pinch area 24, formed by the impression roller 26 and the printing cylinder 18, the boundary layer of air is peeled away from the surface 14 of web 13. The air then flows over the surface 20 of the printing cylinder 18, thereby picking up solvent from the ink. The doctor blade 32 is in contact with the surface 20 of the printing cylinder 18 and acts as an effective barrier to the flow of air. As a result, the air is forced to travel along the top surface of doctor blade 32 toward the inlet portion 44 of the scavenger 38. Additionally, inasmuch as the exhaust fan 58 supplies a vacuum or suction to chamber 40, and therefore to inlet portion 44 of the scavenger 38, the solvent laden air is captured by scavenger 38. The volume of boundary layer air is a function of the length of the straight web run ahead of the pinch. The problem is greater in an Albert press than in a Motter press.

In accordance with the invention, boundary layer air scraper 12 reduces the volume of air which is drawn by the moving web 13 into the press. A panel 66 is located adjacent moving web 13 and extends upstream of the web from a first end 67, adjacent pinch 24 and doctor blade 32, to a second end 68 which is spaced therefrom. The panel 66 is preferably parallel with the web 13 and has a width substantially equal to the width of the web. A scraper blade 69 is fixed to the panel at the first end 67 and extends from the panel toward web 13 and at a right angle thereto.

Panel 66 may, for example, be the door of a hood which extends along the web, and the panel is pivoted to swing on an axis 70 at second end 68, as indicated by arrow 71. Typically, the panel 66 may be spaced from the web 3 or 4 inches; and the edge 72 of scraper blade 69 is spaced from the web a distance of the order of ¼ inch. The air scraper 12 reduces the volume of air drawn by the moving web to the printing cylinder 18. Accordingly, the capacity required by the scavenger 38 is reduced, due to the decreased volume of solvent laden air being created during press operation. Downstream of the scavenger 38, the solvent recovery system can be downsized or have relatively increased performance due to the fact that the volume of solvent being recovered is correspondingly reduced.

The pivotal mounting of panel 66 on axis 70 allows the panel to be swung away from the web to provide access to the web. For example, when the pressman is threading a web through the press it is necessary that there be access to the area inside the panel.

The volume of air drawn to the press with the scraper of FIGS. 1 and 2 is a function of several geometric factors of the press and scraper installation. With particular reference to FIGS. 3 and 4, the edge 72 of scraper blade 69 is spaced from the web 13 a distance t. The length of web 13 between scraper blade 69 and idler roller 22 is $x_1$; and the length of web 13 from idler roller 22 to the pinch 24 is $x_2$.

The air velocity distribution outwardly from the web is shown graphically in FIG. 4 at three positions. At position 1, upstream from scraper blade 69 and inside panel 66, the air velocity distribution follows the curve 80 from a maximum adjacent the web to 0 at the inner surface of panel 66. Position 2, at the scraper blade 69, has a band of air of constant velocity and a width equal to the scraper blade edge spacing t. At location 3, downstream from the scraper blade 69, the moving air has a portion of width t adjacent the web at a constant velocity. The velocity drops exponentially as the distance y from the web increases.

The volume of air in cubic feet per minute, for example, may be shown to be expressed by the relationship $$CFM = VW\left[\left(\frac{0.37\left(\frac{v}{V}x\right)^{1/5} X}{8}\right) + t\right]$$

where,

V = web velocity

W = Web width v = Kinematic viscosity of air at 72° F. The air volume calculation is used in designing the scavenger which should have a capacity of the order of 30% greater than the anticipated air flow.

A preferred form of the scraper blade is shown diagrammatically in FIG. 5. A brush 81 of carbon filament bristles 82 forms the scraper blade. The bristles 82 are mounted in a base 83 secured to the end 67 of panel 66 by angle 84. The carbon filament bristles 82 are tightly meshed to form a barrier to air movement but are flexible to yield and allow foreign objects (not shown) on web 13 to pass. An additional advantage of the carbon filament bristles is that they are conductive and are electrically grounded through base 83, angle 84 and a suitable circuit (not shown). The grounded bristles, which have relatively sharp ends closely adjacent web 13, act to dissipate static electricity developed in the web by its movement through the press. The dissipation of static electricity in the web is desirable as the web is ultimately cut into sheets which, if charged, tend to stick together and are difficult to handle.

I claim:

1. In a rotogravure printing press including, a rotatable printing cylinder having an outer surface, a rotatable impression roller forming a pinch with said printing cylinder, means for directing a moving web to be printed through the pinch, movement of said web drawing air to said printing cylinder, an ink fountain for applying ink having a volatile solvent to the surface of said printing cylinder for transfer to said moving web in said pinch, a scavenger adjacent the pinch for capturing air drawn to said printing cylinder by movement of said web, which air has become laden with solvent from the ink on said printing cylinder, to minimize the dispersion of solvent laden air to the area surrounding said printing press, the improvement comprising an air scraper having:

a panel adjacent said moving web and extending upstream of the web from a first end adjacent said pinch and scavenger to a second end spaced therefrom; and a scraper blade at said first end of the panel and extending from the panel toward the web, said scraper blade blocking the flow of air drawn by the web to the printing cylinder and reducing the volume of solvent laden air to be captured by said scavenger.

2. The air scraper of claim 1 wherein said panel and scraper blade have a width substantially equal to the width of said web.

3. The air scraper of claim 1 in which said panel is pivoted at said second end to swing away from the web.

4. The air scraper of claim 1 in which said panel is generally parallel with the web and said scraper blade is a plate extending from the panel generally at right angles to the web.

5. The air scraper of claim 1 in which said scraper blade has an edge spaced from the web a distance of the order of ¼ inch.

6. The scraper of claim 1 in which the scraper blade is conductive.

7. The scraper of claim 1 in which said scraper blade is flexible.

8. The air scraper of claim 1 in which said scraper blade is a carbon brush.

9. The air scraper of claim 8 in which said carbon brush has tightly meshed carbon bristles.

10. The air scraper of claim 9 in which said carbon bristles are conductive and flexible.

11. The air scraper of claim 10 in which said carbon bristles have ends spaced from the web surface a distance of the order of ¼ inch.

* * * * *